United States Patent [19]

MacDougall

[11] 4,377,319

[45] Mar. 22, 1983

[54] LOW INSERTION FORCE DIP CONNECTOR

[75] Inventor: Alan R. MacDougall, Harrisburg, Pa.

[73] Assignee: AMP Incorporated, Harrisburg, Pa.

[21] Appl. No.: 229,044

[22] Filed: Jan. 28, 1981

[51] Int. Cl.[3] ..... H01R 13/629

[52] U.S. Cl. ..... 339/75 M; 339/17 CF

[58] Field of Search ..... 339/17 CF, 74 R, 75 M, 339/75 MP, 176 MP

[56] References Cited

U.S. PATENT DOCUMENTS

| | | | |
|---|---|---|---|
| 3,568,134 | 3/1971 | Anhalt et al. | 339/75 MP |
| 3,763,459 | 10/1973 | Millis | 339/75 |
| 3,793,609 | 2/1974 | McIver | 339/176 MP |
| 3,883,207 | 5/1975 | Tomkiewicz | 339/75 M |
| 4,054,347 | 10/1977 | Mouissie | 339/17 CF |
| 4,076,362 | 2/1978 | Ichimura | 339/75 |
| 4,188,200 | 2/1980 | Yeager et al. | 339/75 |
| 4,189,199 | 2/1980 | Grau | 339/17 CF |
| 4,266,840 | 5/1981 | Seidler | 339/75 M |

FOREIGN PATENT DOCUMENTS

| | | | |
|---|---|---|---|
| 2275964 | 1/1976 | France | 339/74 R |

*Primary Examiner*—John McQuade

*Attorney, Agent, or Firm*—Gerald K. Kita

[57] ABSTRACT

A low insertion force connector for DIP leads includes a pair of pusher rails for engaging and closing normally open receptacle contacts. The rails cooperate with a unitary, lever actuated cam. A cover retains the rails and cam stackably assembled to a housing containing the contacts. The cam has serially arranged cam surfaces, guide keys and detents which interengage various assembled parts of the connector.

4 Claims, 9 Drawing Figures

LOW INSERTION FORCE DIP CONNECTOR

FIELD OF THE INVENTION

The present invention relates to a low insertion force connector particularly adapted for connection to the electrical leads of an electronic, dual in line package (DIP).

BACKGROUND OF THE INVENTION

A dual in line package (DIP) encapsulates an electronic circuit and provides two rows of pluggable electrical leads which are suited for pluggable connection into a socket type electrical connector, typically mounted on a circuit board. A desired objective is to minimize the total force generated when plugging the leads simultaneously into a connector.

In a low insertion force connector for connection to circuit cards, there are two rows of contacts which face each other across a card slot into which the card is pluggably inserted. The contacts are pivoted in directions toward or away from the inserted card. The contacts brush the card and are not receptacles which need to be opened and closed. The mechanism which pivots card engaging contacts is not readily adaptable to opening and closing receptacle contacts.

A low insertion force connector, disclosed in U.S. Pat. No. 3,763,459, includes receptacle contacts which have opposing jaws. The jaws are normally apart to receive DIP leads therebetween. The jaws also project through openings through a shutter which shifts linearly to close the openings upon the jaws, which, in turn, close on the DIP leads.

BRIEF DESCRIPTION

The present invention relates to a low insertion force connector for DIP leads having normally open receptacle contacts arranged in two spaced rows. A cam mechanism for closing the contacts is disposed between the rows, and includes a unitary cam with oblong cam surfaces, guide keys and detents serially arranged on a rotatable shaft portion. A pair of pusher rails are interposed between the shaft and respective rows of contacts, and are biased by the rotated cam surfaces toward the receptacles to engage and close the same. A cover is assembled over the shaft and the rails and is latched to a housing containing the contacts. The keys on the shaft cooperate with keyways in the housing to guide the shaft during rotation thereof. The detents cooperate with projections on the cover to retain the shaft either in a closed position or an open positon. The various parts are plastic, designed for straight draw molding and assembly merely by stacking and self latching together.

OBJECTS

An object of the present invention is to provide a low insertion force connector for DIP leads in which the plastic parts are designed for straight draw molding and assembly merely by stacking and self latching together.

Another object is to provide a cam actuated, low insertion force connector for DIP leads having pusher rails actuated by oblong cam surfaces, both integral with a rotatable shaft, and serially arranged on the shaft with guide keys and detents.

Another object is to provide a low insertion force connector for DIP leads in which normally open receptacle contacts are closed by a cam mechanism the parts of which are designed for straight draw molding and which are capable of assembly by stacking and self latching together.

Other objects and advantages of the present invention will become apparent from the following detailed description taken in conjunction with the drawings.

DETAILED DESCRIPTION

Figure 1:
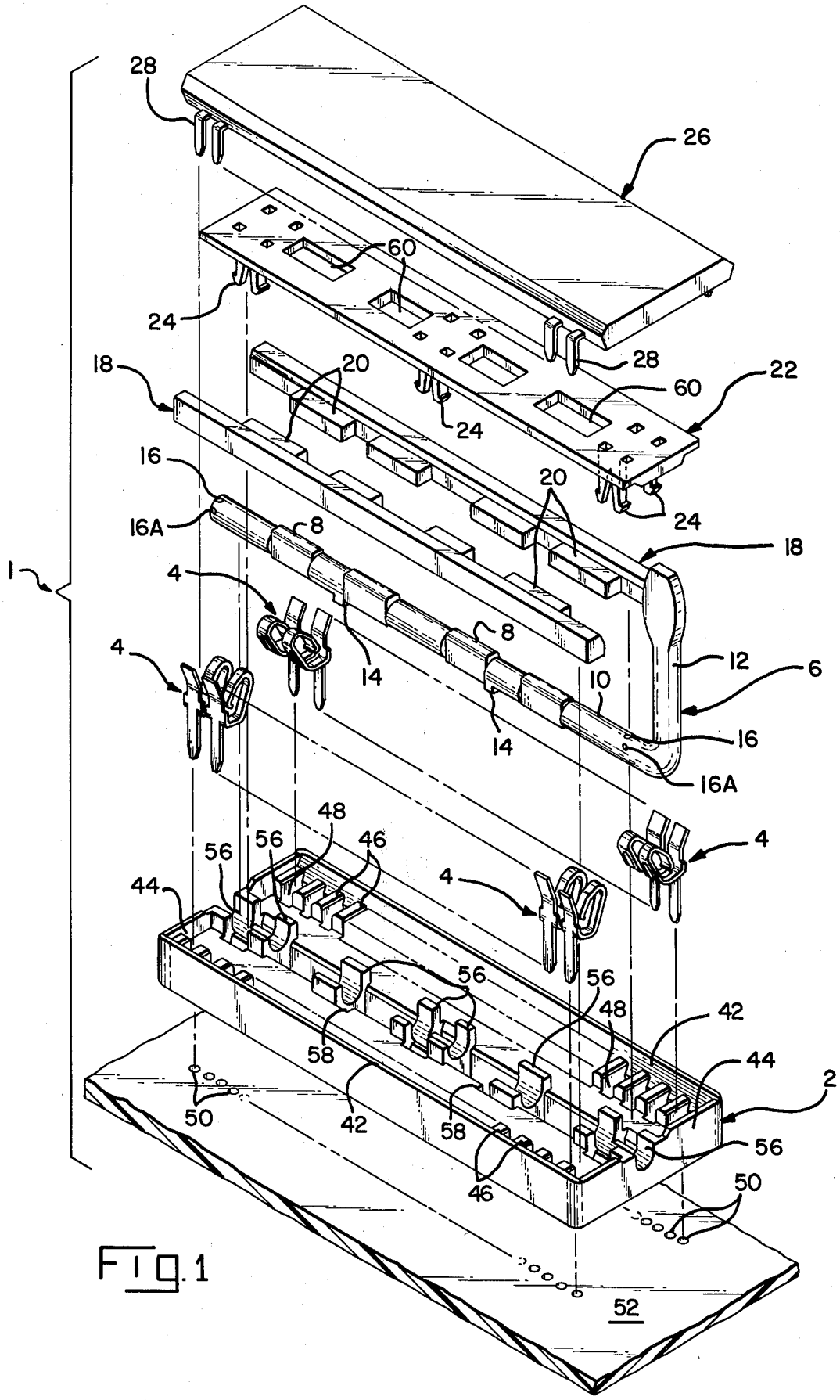
FIG. 1 is a perspective with parts exploded of a preferred embodiment of a connector according to the present invention.

FIG. 1 illustrates a connector generally at 1 comprising a molded plastic base 2 in which are mounted two rows of electrical receptacles or contacts 4. A unitary molded plastic cam 6 includes a series of oblong cam surfaces 8 along an elongated shaft 10 which is rotatable about its central axis by manual pivoting of transverse lever 12 integral with the shaft. One or more keys 14 project radially from the shaft and are disposed serially along the shaft. Also provided serially along the shaft are depressions 16 and 16A arc spaced apart and molded into the shaft. Also illustrated are a pair of identical, opposing elongated pusher rails 18 alongside the shaft 10 and interposed between the shaft and a respective row of contacts. Integral follower surfaces 20 project toward respective cam surfaces 8. A unitary molded plastic cover 22 overlies the shaft 10 and the rails 18. The cover has integral, depending latches 24 which latch to the base 2. Also shown in FIG. 1 is a dual in line package (DIP) 26 with two rows of depending electrical leads 28 which are to be plugged into respective, normally open receptacles 4, the receptacles to be closed onto the leads to establish electrical connections therewith. A more specific explanation follows in reference to additional drawing figures.

Figure 9:
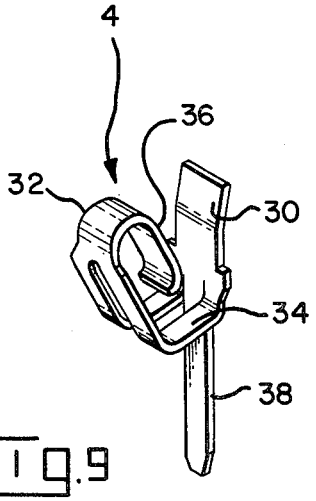
FIG. 9 is perspective of one of the contacts of the connector.

FIG. 9 shows each receptacle 4 stamped and formed from resilient spring metal and having a fixed arm 30 and an opposed resilient arm 32 joined integrally by bight 34 to arm 30. The free end 36 of arm 32 is curved into the space between the arms 32 and 30, and is normally spaced apart from arm 30 to define a normally open receptacle which is closed by resiliently deflecting arm 32 toward arm 30. A depending electrical lead 38 is cut out from the arm 32 and bight 34 and remains attached to the remainder of the receptacle 4.

Figure 2:
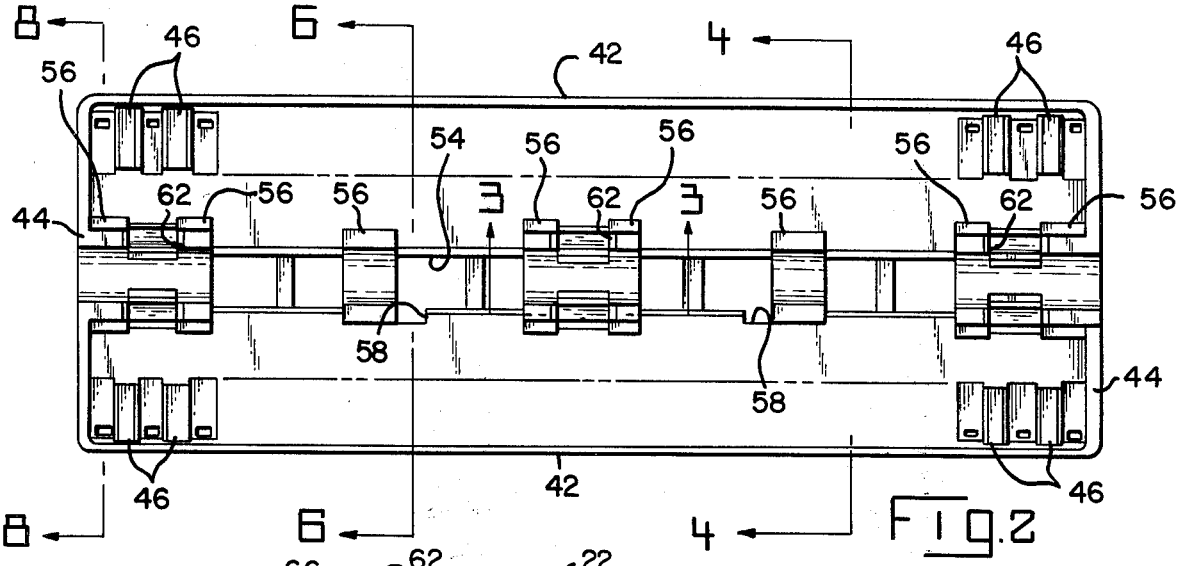
FIG. 2 is a top plan view of a housing portion of the connector.
Figure 4:
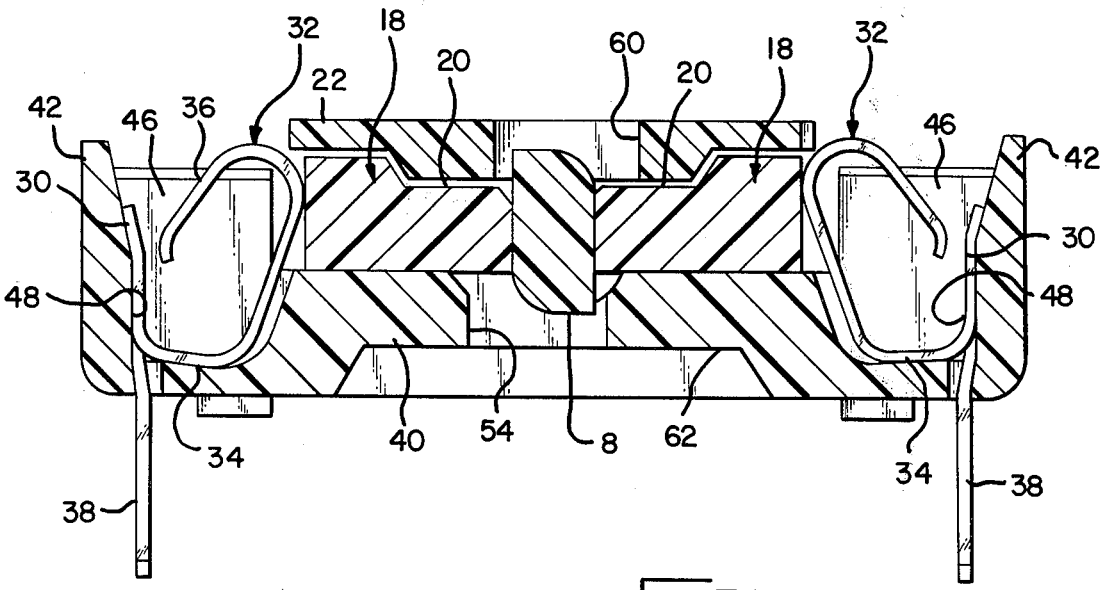
FIG. 4 is a section taken along line 4—4 of FIG. 2.

FIGS. 1, 2, and 4 illustrate base 2 molded in one piece with a thickened bottom wall 40 from which project outer peripheral side walls 42 and end walls 44. Along each side wall 42 are molded a row of spaced partitions 46 projecting upward from the bottom wall 40. The partitions separate contact receiving cavities 48 in bottom wall 40 and in which are seated respective bight portions 34 of contacts 4. The leads 38 project through the bottom wall 40 and are adapted for plugging into apertures 50 of a printed circuit board 52. The arms 32 of the contacts project laterally beyond the side edges of partitions 46 to impinge a respective rail 18 slidably mounted on bottom wall 40.

Bottom wall 40 is recessed with a central elongated channel 54 bridged across by a series of molded projecting, U-shaped cradles 56 which support the shaft 10 for rotation. The end most cradles 56 also are recessed into endwalls 44. Lever 12 projects outwardly from one endwall 44.

Figure 6:
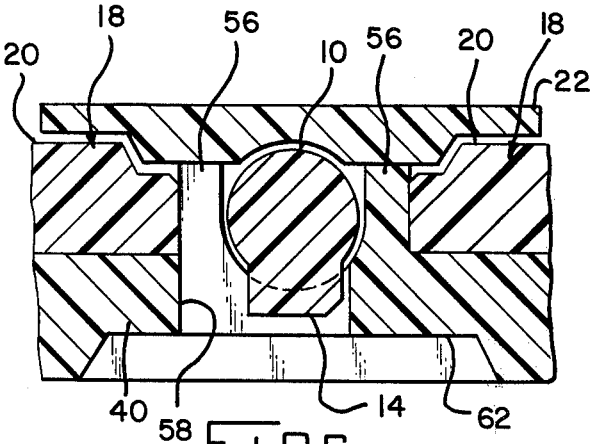
FIGS. 6 and 7 are fragmentary sections taken along line 6—6 of FIG. 2 illustrating a key in a cooperating keyway.
Figure 7:
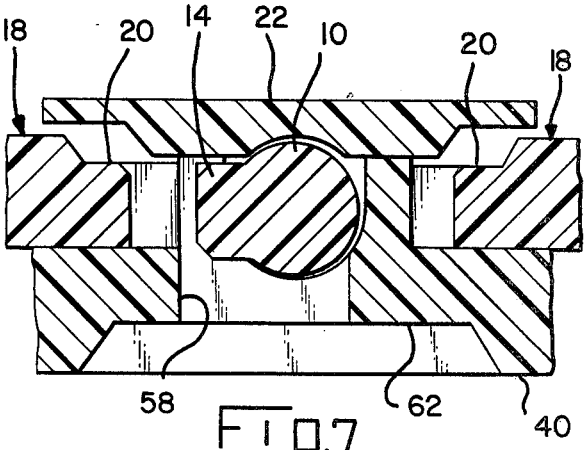

The base 2 further is provided with laterally recessed keyways 58 alongside respective cradles 56, and communicating with channel 54. The shaft 10 is stacked onto the cradles 56 with the cam surfaces 8 and keys 14 projecting freely into the channel 54. The other ends of cam surfaces 8 project freely into recesses 60 in the cover. The cover seats against the tops of the cradles providing clearance underneath for movement of the parts. FIGS. 6 and 7 illustrate the keys slidably guided along keyways 58 upon rotation of shaft 10 from an open position to a closed position.

Figure 3:
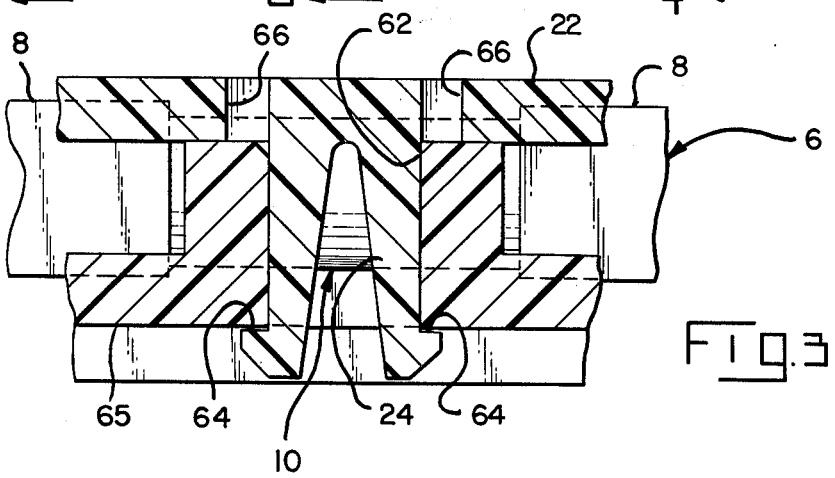
FIG. 3 is a fragmentary section taken along line 3—3 of FIG. 2.
Figure 8:
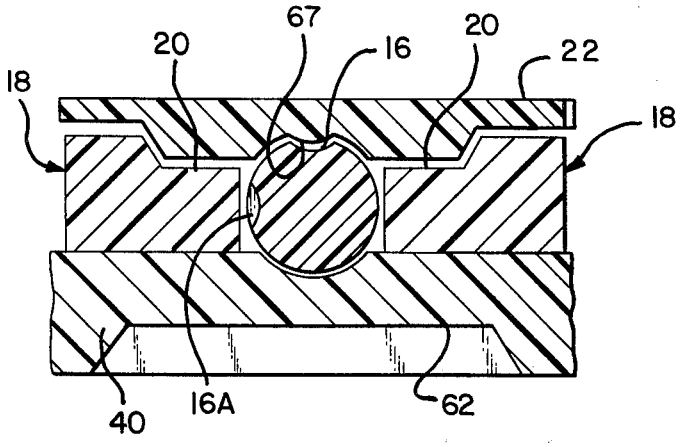
FIG. 8 is a fragmentary section taken along line 8—8 of FIG. 2 and illustrating detent action of the cam.

The base 2 further is provided with latch receiving recesses 62 flanked on both sides by respective cradles 56. FIG. 3 shows the latches 24 of cover 22 passing through recesses 62, and shoulders 64 on the latch fingers overlapping and latching against an undercut bottom surface 65 of the bottom wall 40. During molding of the cover in a straight draw mold, core pins (not shown) project through the cover 22 and provide a mold form against which the shoulders are molded and formed. When the pins are withdrawn they leave behind in their place core pin apertures 66 in alignment with the shoulders 64. FIG. 8 shows the cover molded with an inverted, rounded projection 67 which registers in one detent 16 when shaft 10 is in an open position. When the shaft is rotated to a closed position the detent action is overcome, and depression 16A will become rotated into position for registration with projection 67. The shaft 10 thereby is retained in its open or its closed position.

Figure 5:
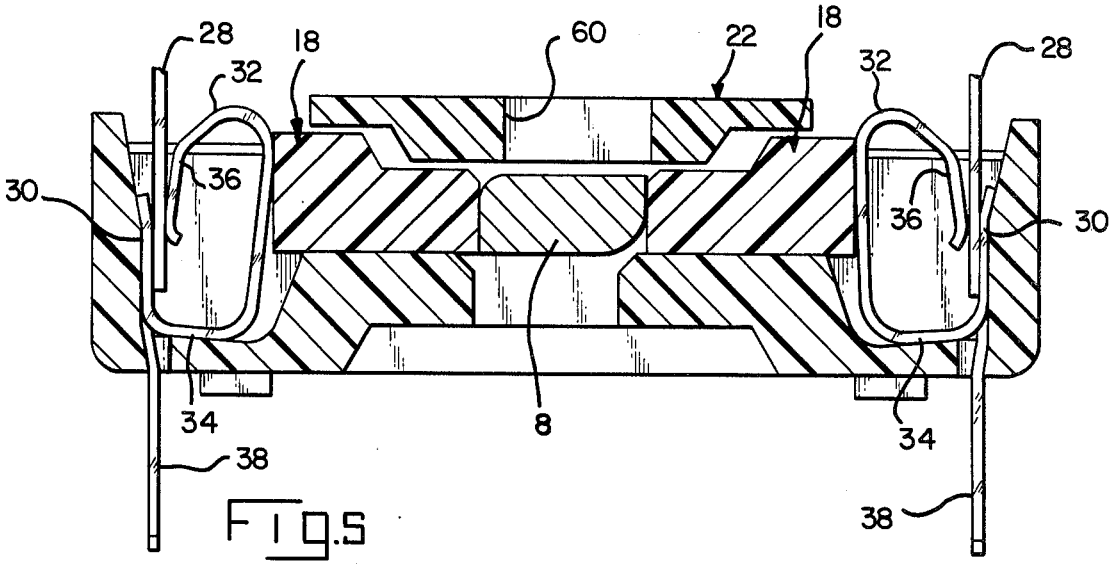
FIG. 5 is a view similar to FIG. 4 illustrating actuation of a cam for closing receptacle contacts of the connector.

FIG. 4 shows the parts assembled by merely stacking together and latching the cover to the base 2. The receptacles are normally open and ready to receive leads 20. The leads are plugged into the open receptacles with a low insertion force. Upon rotation of the shaft 10, by manually pivoting the lever 6, the shaft is rotated from an open position shown in FIG. 4, to a closed position shown in FIG. 5. The elongated projecting portions of the cam surfaces are pivoted to extend radially outward of shaft 10, and are urged against the followers 20, slidably displacing the rails 18 against the contacts, closing the contacts by resiliently deflecting arms 32 toward respective arms 30. The arms of the closed receptacles engage and grip therebetween the inserted DIP leads 28 establishing electrical connections therewith. When the shaft is rotated again to an open position, the deflected arms resiliently spring away from arms 30, releasing their grip on the leads 28.

Although a preferred embodiment of the present invention is disclosed, other embodiments and modifications thereof which would be apparent to one having ordinary skill is intended to be covered by the spirit and scope of the appended claims.

What is claimed is:

1. A low insertion force connector, including: a housing having parallel rows of contact receiving cavities, electrical contacts in said cavities having resilient receptacle portions normally open to facilitate low insertion force receipt of male electrical leads, and a manually actuated cam for closing said resilient receptacle portions onto said leads to establish electrical connections therewith, characterized in that, said cam includes a unitary shaft having a transverse projecting lever for rotating said shaft about an axis of rotation, one or more guide keys each projecting radially of said axis and received slidably along a respective keyway in said housing, and a series of oblong cam surfaces projecting radially of said axis, a pair of pusher rails slidably supported by said housing and interposed between said receptacle portions and said cam surfaces, whereby said cam surfaces are rotatable with said shaft and urge said rails slidably against said receptacle portions to close the same, said housing is molded with a series of integral cradles supporting said shaft, and a cover overlies said shaft and said rails, said keys, said cam surfaces and said cradles are serially arranged.

2. The structure as recited in claim 1, wherein, said cover includes a series of integral latches secured to said housing and serially arranged with said keys, said cam surfaces and said cradles.

3. The structure as recited in claim 1, wherein, said cover includes a projection and said shaft includes arc spaced detents, in turn, pivoted on said shaft into detented registration with said projection.

4. The structure as recited in claim 1, wherein said cover is seated against said cradles providing clearance underneath for movement of said shaft and said rails.

* * * * *